US005169207A

United States Patent [19]

Rye

[11] Patent Number: 5,169,207

[45] Date of Patent: Dec. 8, 1992

[54] CABLE TENSION HEIGHT ADJUSTABLE ARM RESTS

[76] Inventor: Ralph K. Rye, 1559 College St., SE., Grand Rapids, Mich. 49501

[21] Appl. No.: 761,639

[22] Filed: Sep. 18, 1991

[51] Int. Cl.[5] ..... A47C 7/54

[52] U.S. Cl. ..... 297/411; 297/417

[58] Field of Search ..... 297/411, 412, 417, 418, 297/422, 40, 115, 116, 117; 248/284; 211/101, 173; 74/501.5 R, 501.5 H, 501.6; 108/4, 7, 9, 10, 145

[56] References Cited

U.S. PATENT DOCUMENTS

| | | | |
|---|---|---|---|
| 3,489,458 | 1/1970 | Karlsen | 297/417 |
| 4,244,623 | 1/1981 | Hall et al. | 297/417 |
| 4,311,338 | 1/1982 | Moorhouse | 297/417 X |
| 4,496,190 | 1/1985 | Barley | 297/411 |
| 4,674,790 | 6/1987 | Johnson | 297/417 X |
| 4,828,323 | 5/1989 | Brodersen et al. | 248/284 X |
| 4,872,727 | 10/1989 | Rye | 297/413 X |

*Primary Examiner*—Kenneth J. Dorner
*Assistant Examiner*—James M. Gardner
*Attorney, Agent, or Firm*—Miller, Morriss & Pappas

[57] ABSTRACT

A height adjustable arm structure in which a selectively operated drive concealable in and connectable to the frame of a furniture piece includes at least one pair of articulated arm elements and said arm elements subjected to a seletive constant bias acting upon the articulating pivots through the entire range of adjustment.

6 Claims, 5 Drawing Sheets

CABLE TENSION HEIGHT ADJUSTABLE ARM RESTS

The present invention is directed to a cable operated chair arm rest driveable through an eccentric drive linkage concealable in the back of a chair and acting upon an arm-pocketed plurality of blocks over which the cables are trained in each arm and the arms functioning registrably to provide elevation adjustment. The arms each comprise a pair of articulated pieces, the fore arm and the rear arm. The fore arm piece includes an operating control which is remotely connected to a power source which controls the amount of selected arm movement for both chair arms. In addition, at the elbow of each arm are tension adjustment structures for fine tuning the sensitivity of the movement so as to assure smooth registering movement while providing firm arm support under constant tension of the cables.

BACKGROUND OF THE INVENTION

In furniture, especially, the arms of chairs have presented a problem accentuated by the physiological variances in persons using the chairs and in the many relative positions desired by the occupants of the chairs.

In 1988, the prior structures saw a substantial advancement as embodied in the Adjustable Armed Chair of Ralph K. Rye, the inventor herein, expressed in the prior U.S. Pat. No. 4,872,727. In that work, the inventive directions looked toward a simple parallelogram structure operating on a pantographic frame and adapted to the modern ergonometric seating with the capability of utilizing the chair back as the concealment for the structural connection and for the power element. The U.S. Pat. No. 4,872,727 made a substantive impression on the industry, but the most severe criticism was directed at the almost impossible task of maintaining clearance at the pivots or joints to assure a tight and smooth connection. In use, clearances were introduced in the journalling and no simple solutions were available in maintaining tight joints resistant to vertical and horizontal displacement.

Accordingly, the inventor sought to improve the structure by seeking the elimination of control of wear factors at the pivots and after substantial effort and expenditure of money and time, the present construction began to take shape. A rigid framing structure for the arms was devised. Within that framing or housing of the arm elements, pivots on elongate substantially sized through-bushings were located and steel cables operating on the pivots or the blocks and in guided anti-friction relation were interlaced and tensioned to perform as desired at those selected and adjustable tensions. A more stable set of adjustable arms resulted and the simple tightening of the cable yields a system under substantially constant tension, which is amendable to power actuation, field adjustment, and provides the desired quantum of structural stability. Accordingly, the principal object is to achieve a higher order of stability. A closely related object is the attainment of stability with a constant tension cable control system. A further object is appreciated in the achievement of the foregoing objects at an economical cost. Additionally, the adaptability of the invention to a wide variety of furniture styling and design in chairs is an overall object, while other uses for elevating adjustment of extended arm elements are contemplated.

BRIEF DESCRIPTION OF THE DRAWINGS

In the Drawings:

FIG. 5 also indicates the position of the eccentric drive connection between the power cylinder and the control shaft. In addition, the cable tensioning means are visible at the rear of the chair arm structure and secured to the frame.

GENERAL DESCRIPTION

The height adjustable arm rest structure for chairs is a cable tensioned structure supported by a frame permitting its attachment to existing back structures of chairs. The arm rest elements extend from the support frame in articulated segments or portions on each side of a chair seat. The framing supports a drive shaft to which the inboard portions of the arms are rigidly connected. Motor means, also fastened to the frame, is connected operably to the drive shaft. Movement of the shaft by selected activation of the motor causes operation of the arm portions. The arm sections fore (front) and aft (rear), on each side, move in unison, or registry, unless it is desired to operate them so that each is separately moveable. A closed loop cable over the drive shaft axis on each arm, and over the intermediate common journal axis and pinned to the bar includes a crossover traverse over a double wheel connection intermediate the ends of the aft arm portions.

The articulating joint between the fore and aft arm portions are pivotal and on common axes. Intermediate the drive shaft (and the articulating pivot) at the connections of the forearm portion to the aft arm a spiral grooved guide pivot or axle having grooves, properly guides the cable loop and provides a smooth running journal bed for each run of the cable. This construction assures attainment of the level set of the arm positions and also maintains guide contact with the surfaces over which the cable is trained to keep uniform tension on the cable. The level of constant tension imparts lateral guide control of cable and adds lateral stability to the arm rests.

An arm support block is provided on each of the ends of the drive shaft. Behind each support block the tensioning mechanism or tension cluster is positioned in receipt of the ends of the cable loop. Tension is adjusted by means of a tension block displaced by a screw and the tension, once set, is lockable by lock screws and the tension mechanism of the aft arms on both sides of the structure is secured to the seat back support bar.

SPECIFIC DESCRIPTION OF THE PREFERRED EMBODIMENT

Figure 1:
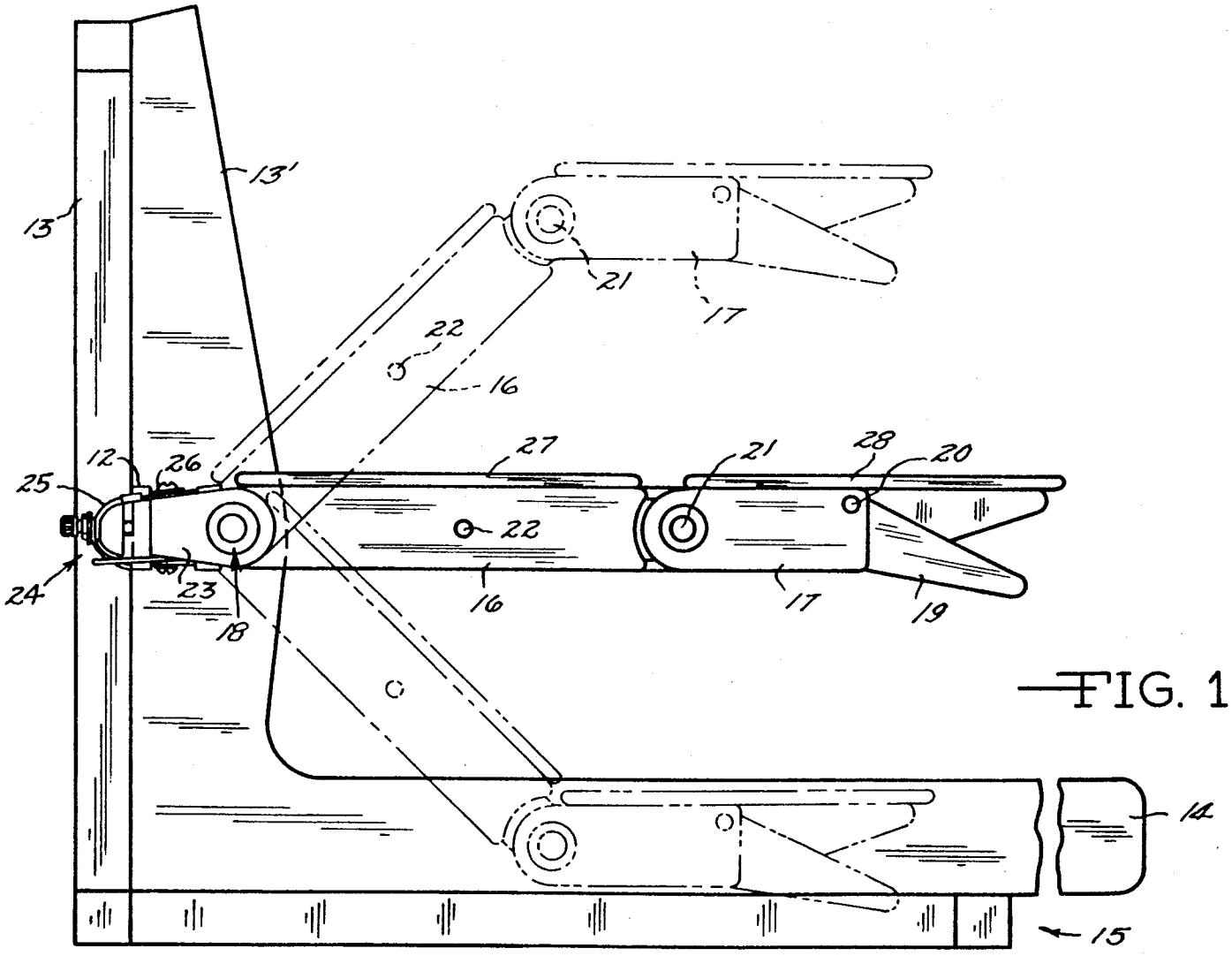
FIG. 1 is a side elevation view of a height adjustable chair arm in accord with the present invention and indicating in phantom-line the typical elevation selection range, both up and down, in respect to a typical chair back and bottom or seat.

In the drawings, presenting the preferred embodiment, and with particular first attention to the FIG. 1, the height adjustable arm rest structure 11 in a frame 12 is seen secured to the chair back 13 and extending forwardly from the back 13. The arm rest structure 11 is shown in full extension in full lines and in full extremes of adjustment in phantom line. It will be appreciated that the arm positions flank the seat 14 of the chair 15 and that the chair 15 may be of the pedestal type or adjustable type or stationary type in a galaxy of styles and that the arm structure 11 on both sides of the chair 15 consists of two elongate portions 16 and 17, the aft arm portion 16 and the forearm portion 17.

The arm rest structure 11 is preferably on both sides of the chair 15 and both are preferred to function in unison and registrably around the adjustment on the axis of the articulating axle 18 as clearly indicated in its extremes of up and down movement and while the arm portion 16 moves at variant angles within the extremes of travel, the forearm portion 17 remains in the fixed attitudes (horizontal as shown). The forearm portion 17 includes a trigger or lever 19 functioning off of the trigger pivot 20 in order to initiate a move of the arm rest structure 11, and upon release of the trigger 19 the position of the arm rest structure 11 is locked. While the lock may be achieved in many ways the preferred locking is remotely controlled and the trigger 19, in the preferred embodiment functions through a Bowden-wire system as will be seen. The chair user activates the control as desired. The simple trigger 19 may work both of the pair of arms 11 or triggers 19 may be placed in, selectively, one side or the other, either exercising control. In such instance one side may have a dummy usage. In instances where separate motor systems are used, one motor on each side can be separately controlled as the user wishes and the drive shaft on the axis 18 is broken, each side serving a separate arm rest 11.

The arm portions 16 and 17 are articulated at the common pivot or axle journal 21 supported by the arm position 16. A pivot 22 is intermediate the axles 18 and 21. As will be seen the pivot 22 provides journalling for an intermediate two track roller structure which is of substantial importance in the cable tensioning with the arm rests 16 and 17.

At the axle 18, the connecting blocks 23 (one on each end of the axle 18) provides journalling for the axle 18, both inboard and outboard, and includes bushing flange means, as will be seen, which firmly yet operably guide the arm rests 11 in a planar manner through their entire adjustment range. The blocks 23 are firmly secured to the frame 12 and the frame 12 in turn is attached to the chair back 13. The blocks 23 provide additional flank support for the arms 11 and provide the thrust barrier against the tension adjustment elements in the tension adjustment cluster 24 for the ends of the cable 25 and a support base for the adjustment lock screws 26. Thus the blocks 23 firmly establish the fixed position of axle 18 and provide a thrust buttress for applying the required uniform or constant selected tension. In the FIG. 1 the depth of the chair back 13 between its side plate limits 13' and the vertical chair back elements 13 provide ample space for one or more motor-activator means not seen in the FIG. 1. Appropriate upholstering, padding or trim conceals the motor means in the final form of chair structure. The top covers 27 and 28 close the top surface of the arm portions 16 and 17 and provide a rest surface for panelling, upholstering or the like.

Figure 2:
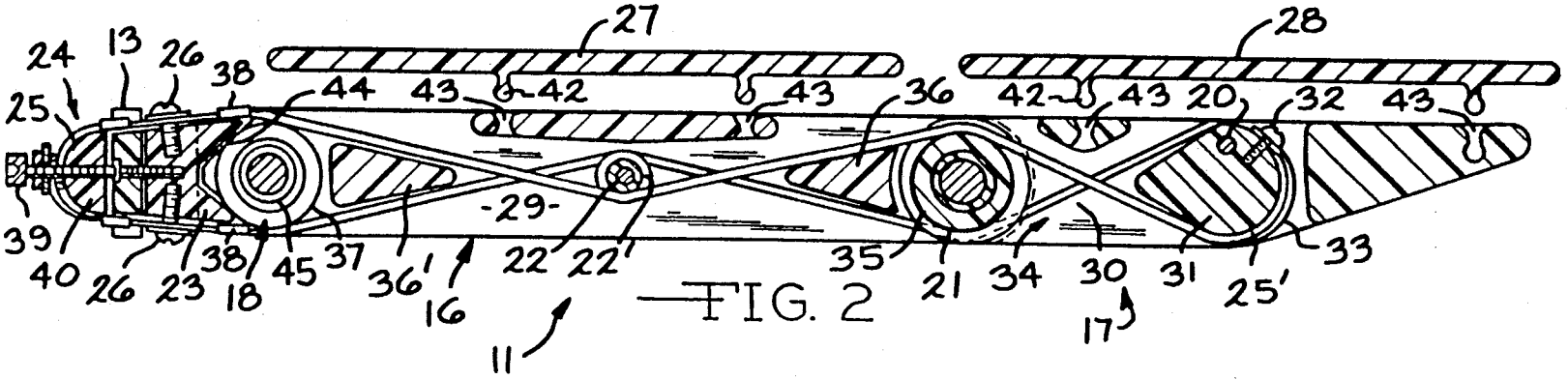
FIG. 2 is a full cross section side elevation view taken on line II—II of FIG. 5 opening the arm of FIG. 1 and indicating the internal arm construction at full extension and in support of the forward and rear arm support plates.

In FIG. 2 the arm rest structure 11 is removed from the chair 15 (left and right chair arms are opposites and in registry with each other) and the structure is somewhat exploded so that the removal of the covers 27 and 28 from the base of arm rests 16 and 17 can best appreciated. This reveals the channeling 29 and 30 through the integral arm portions 16 and 17 in which cable 25 is deployed forming a closed ended loop, the closed end 25' being secured to fixed bar 31 integral within the arm rest portion 17 as by the lock screw 32. The bar 31 is subtly grooved, the groove 33 providing guides for the reversal of the cable 25 at the loop end 25'. The cable 25 crosses at 34 and thereupon is trained over and under the axle 21 and bearing on the intermediate element 35 over the common articulating pivot of axle 21 between arm portions 16 and 17. The cable 25 enters the cavity 29 over the transverse barrier 36 in the arm portion 16 and the lower course of the cable 25 travels over the intermediate twin wheeled roller 22 and the upper course of the cable 25 travels over the separate grooved twin roller 22'. The cable 25 then changes direction moving over the anti-friction journal element 37, thence through ferrules 38 over the support block 23 to terminal connection of both ends of cable 25 at the tension post 39. The tension post 39 acting on thrust block 40 can then be backed away from the block 23 thereby tensioning the cable 25. Such tensioning is thus adjustable and lockable as desired by the flanking lock screws 26 fastening the cable 25 to the blocks 23 at a selected tension and rigidity.

When the arms rest structure 11 is assembled, the covers 27 and 28 are detentably closed on the arm rest portion 16 and 17, respectively, via the engagement of the detents 42 and 43 (respectively male and female) in the covers 27 and 28. The V notch 44 in the support block 23 provides firm support for the arm rest portion 16 and cradles the anti-friction journal element 37 riding on the bushing 45 in which the shaft 18 is journalled.

Figure 3:
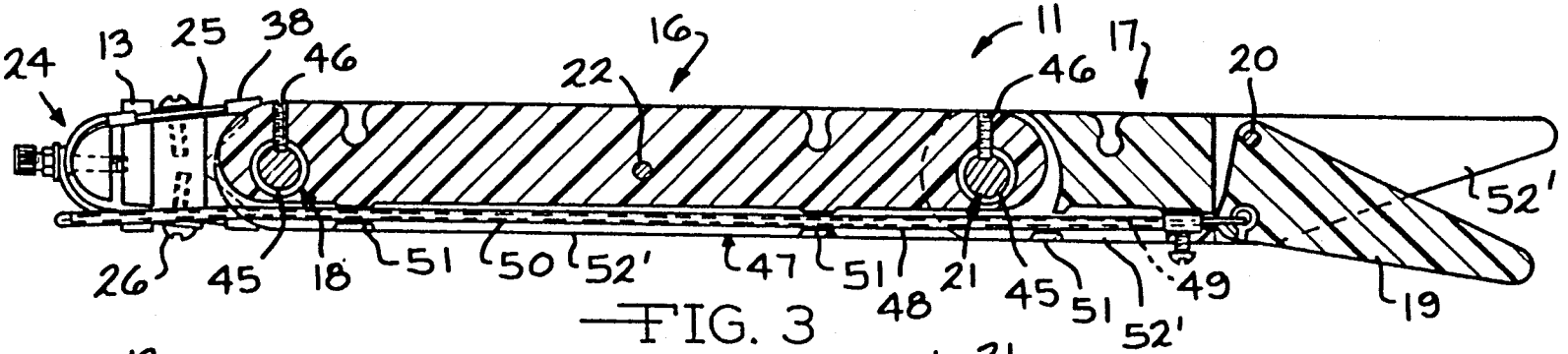
FIG. 3 is a full cross section side elevation view taken on line III—III of FIG. 5 and through the longitudinal center of the chair arm of FIGS. 1 and 2 and indicating the activating trigger control beneath the forward support plates and between the side plate covers.

In FIG. 3 the arm rests 11 or arm portions 16 and 17 are seen with the articulating axles 18 and 21 and the set screws 46 fix the shafts 18 and 21 through the bushings 45. The axle at the pivot 22 supporting two wheeled nylon rollers 22 and 22' is located passing through the side plates of the arm rest portion 16. The FIG. 3 thus reveals the pivot 20 for the trigger element 19 and connected operably to the Bowden-wire assembly 47 of tube sheath 48 and wire rob or core 49. The trigger is connected to the wire rod or core 49. By depressing the trigger 19, the core piece 49 is lineally and guideably moved providing a control over motor means as will be seen. The core piece 49 is under a spring bias as indicated. The Bowden-wire means 47 travels in a channel 50 in the bottom of the arms 16 and 17 and is held in place as by the detents 51. As will be seen, the Bowden-wire structure 47 travels to the remotely positioned motor means.

Figure 4:
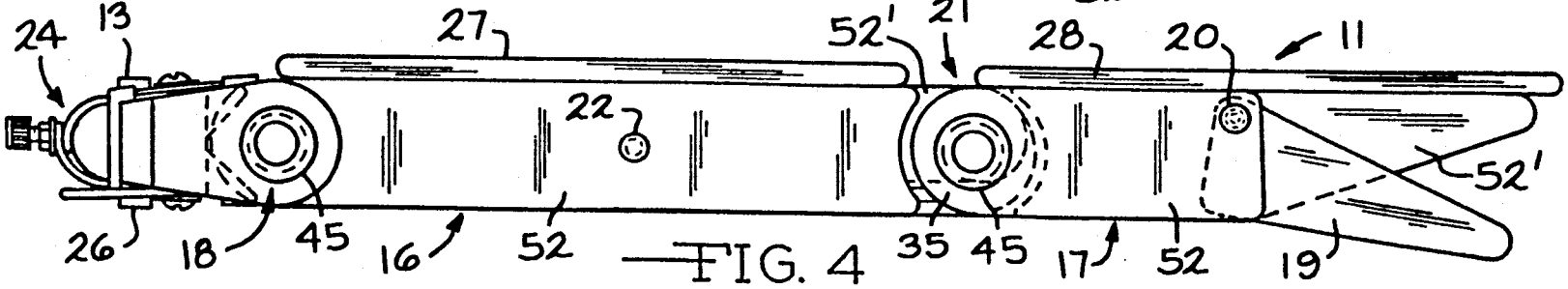
FIG. 4 is a side elevation view of the chair arm seen in FIGS. 1, 2 and 3 and indicating the accommodation for articulation between the front (fore) arm support plate and the rear (aft) arm support plate for the tilting of the arm sections in respect to each other.

In FIG. 4 the total of the arm rest 11 is seen in external profile with the side plates 52 in position.

It will be appreciated that the construction of the arm portions 16 and 17 may be injection molded in which event the channels 29 and 30 (FIG. 2) and the Bowden-wire channel 50 and cross barriers such as 31, 35, 36 and 36' which are integrally formed between side plates 52 and 52' of arm portion 16 and 17 and the trigger element 19 is then assembled to the arm structure 17 and the opening concealed at the top by the cover 27 and 28 and the cable loop 25 is threaded as previously described (FIG. 2) and tensioned by the tension cluster 24. The bushings 45 fixed by set screws 46 are externally flanged adding a structural control to the arms 11 while journalling the shaft and axles as seen.

Figure 5:
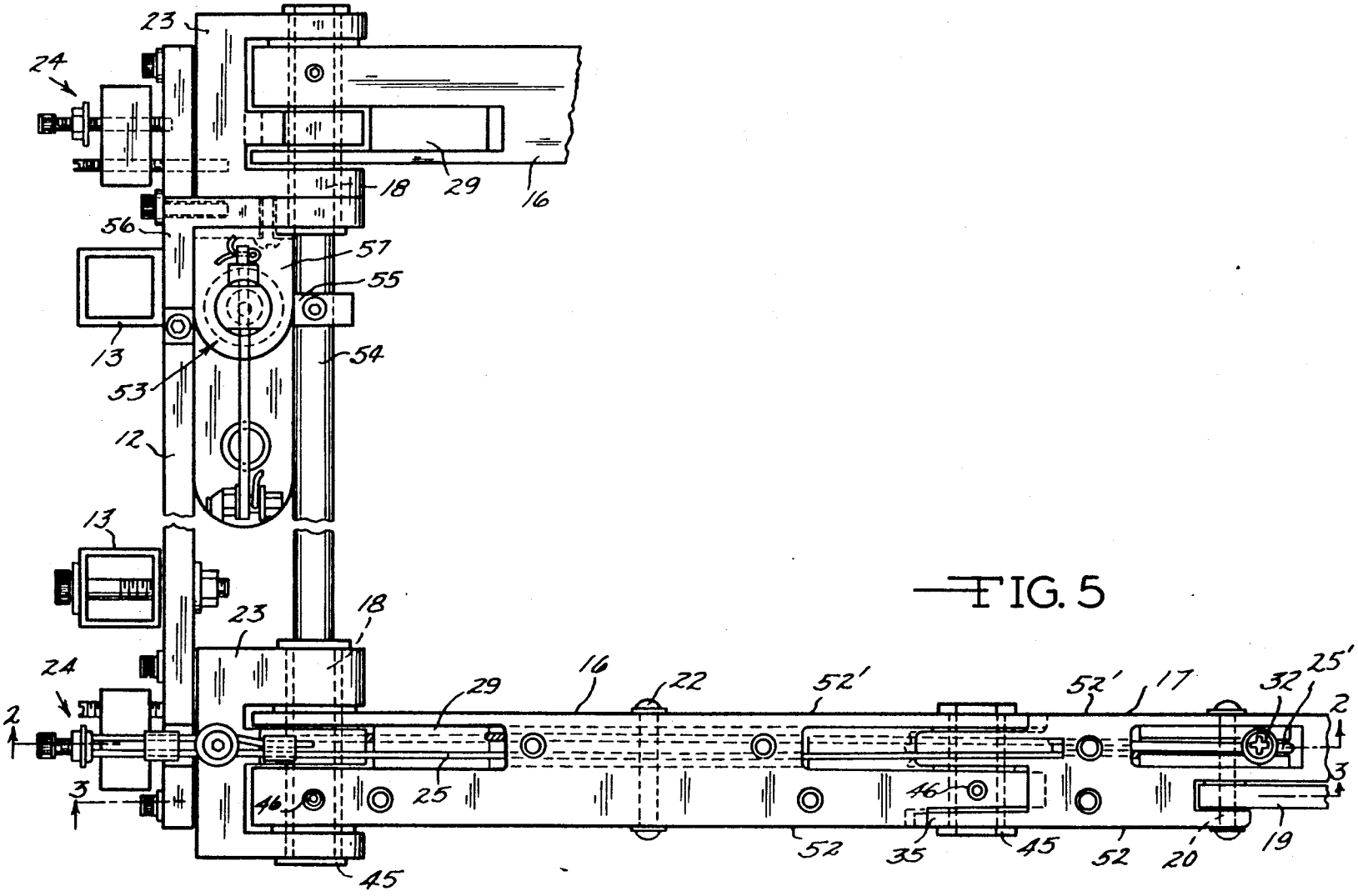
FIG. 5 is a partial top plan view of the chair arms which extend in coordinated fashion in respect to the rotation of the control bar or shaft operably connected to the power means as between the two arms.

The FIG. 5 introduces the power cylinder or motor 53 located between the arm rest elements 11 which extend forwardly of the frame 12 seen earlier in the FIG. 1 and which frame 12 is connected to chair support elements 13 by the support bar of the frame 12. The motor 53 is operably connected to the drive shaft 54 by means of an eccentric connection 55. The drive shaft 54 extends to the arms 11 through the support blocks 23 and related bushings to driveable connection to the arm element 16 at the pivot 18. The top plates 27 and 28 are removed so that the channel openings 29 and 30 are visible and the cable tensioning structure 24, as previously described. The motor 53 is bracketed and secured to the flange plate 56 which centers the cylinder 53 between the frame 12 and the drive shaft 54.

Figure 6:
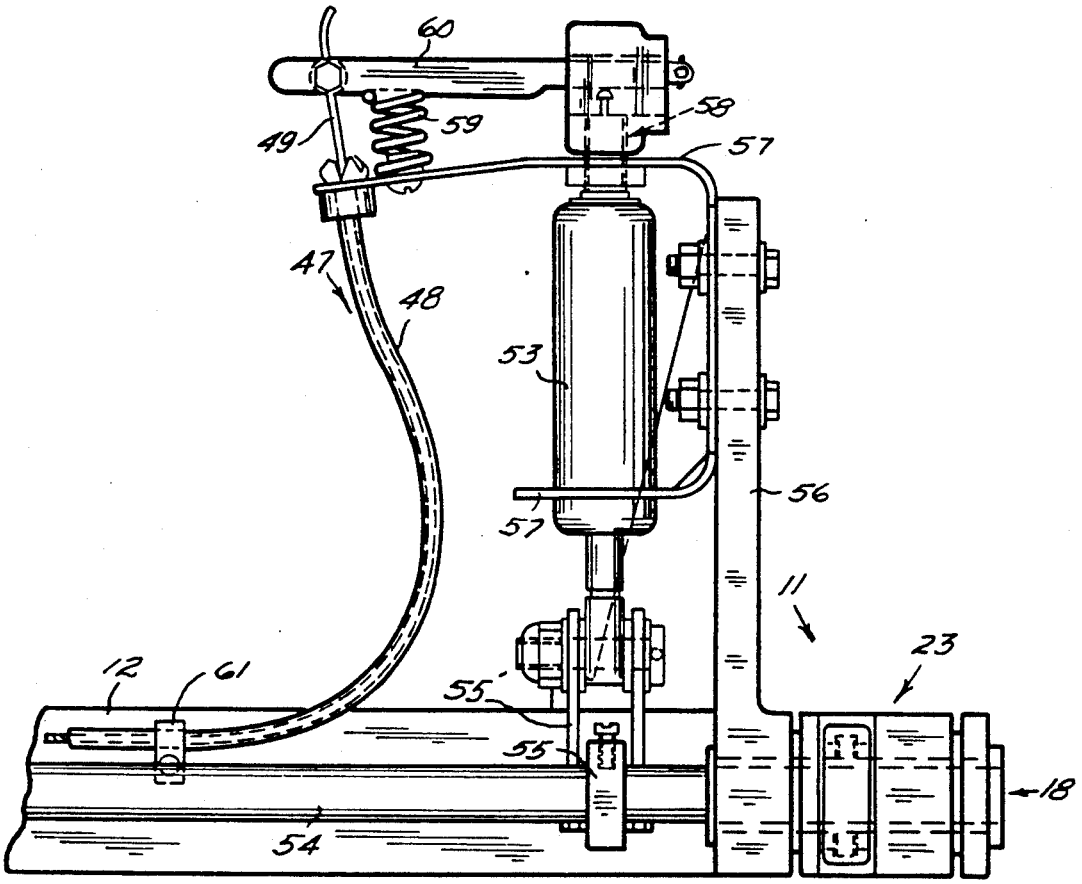
FIG. 6 is a front elevation view of the arm adjustment structure and indicating the eccentric drive applied to the control shaft from the pressure cylinder and indicating the remote control Bowden wire connection for actuation of the cylinder.

In FIG. 6 the motor support bracket 57, directly supporting the cylinder or motor 53, provides the operational orientation so that the motor 53 is located to deliver a selected drive or stroke to the eccentric link 55 and thence to turn the drive shaft 54 and hence to selectively position the arm rests 11 simultaneously as desired.

Two motors (not shown) may be used by separating the drive shaft 54 where desired and it will be appreciated that the gas cylinder motors 53 (such as appear in U.S. Pat. No. 4,872,727) are preferred for lightness and simplicity, each carrying its own source of power through the desired stroke by the mere operation of a valve 58 tripped by selected movement of the trigger 19 and wire core 49 of the Bowden-wire assembly held in place on the frame 12 running from the arm rests 11 or one of them and acting to depress the valve 58 and provided with the return spring 59 as the lever 50 is acted upon. The motor 53 when activated, apply a drive bias tending to elevate the arms. The Bowden-wire assembly 47 is held in place on the frame 12 by clips 61.

Figure 7:
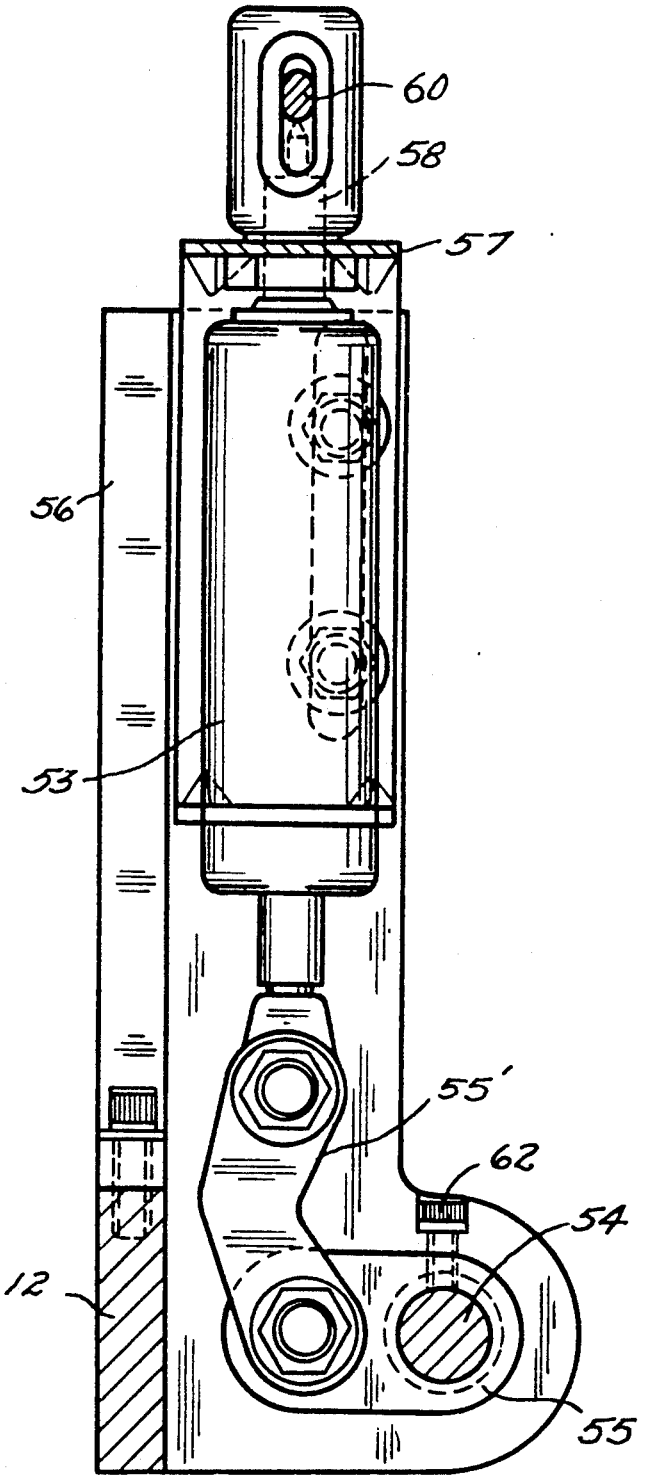
FIG. 7 is a partially broken-away sectional side elevation of the FIG. 6 structure and indicating the bracketing of the drive cylinder and the eccentric drive for the arms and acting through the tensioned cables upon rotation of the drive shaft to selectively move the arms.

By references to FIG. 7, the simplicity of the cylinder form of the motor 53 is appreciated and the eccentric linkage to the drive shaft 54 is best understood. As the Bowden-wire structure 47 is moved by the trigger 19, the lever 60 is depressed against the bias of the spring 59 and finger tip control allows smooth and free location of the arms 11 by rotation of the drive shaft 54 and release of the trigger 19 blocks the stroke of the cylinder or motor 53 freezing the arms 11 in any selected position within the range of movement as seen in FIG. 1. The set screw 62 adjusts the grip of the eccentric link 55 on the drive shaft 54.

The materials useable in the thus described construction may be wood for the arms or metal and plastic or combinations thereof. The size of the anti-friction bearing 37 over which the tensioning cable travels is substantially equal in diameter to the flanged barrier 35 which is integral and is preferred in the form of roller or ball type bearings fitted over the shafts or bushings as previously described.

The two wheel element 22 and 22' is preferably of an anti-friction surface as for example Teflon or Nylon material.

The motor 53 is of a self (Nitrogen cylinder) contained type. It will be appreciated that positive stop worm gear drives permit the use of electric drive motors operable via batteries or other sources of electrical power in which case the drive is selectively reversible and locks when deactivated. With electric drives the electrical drive leads would substantially follow the Bowden-wire course and the central switches may be located as beneath the forearm portions 17 as shown in proximate mounting to the illustrated trigger.

In operation, the arm rest height adjustment of the described structure is smooth and firm in locked selected position and markedly stable against side thrusts against the arm rests and is a function of the selected constant tension in the cable through the arms as described.

Having thus described my invention and the preferred embodiment thereof, a variety of improvements, changes and modifications will be perceived by those skilled in the art and such improvements, changes and modifications are intended to be included in the spirit of the invention limited only by the scope of my hereinafter appended claims.

I claim:

1. An improved height adjustment for chair arms comprising:

at least one two-part articulated arm structure having a first arm portion and a second articulated outboard portion;

a remotely actuated drive shaft to which said first arm portion is secured;

remotely controlled drive means selectively rotating said drive shaft;

a first journal means on said first arm portion and adjacent the outboard arm portion;

a second journal means at the connection between said articulated arm portions;

tensioned cable means over the axis of said first journal means and over said second said journal means; said cable extending in a loop through said first arm portion;

an idling roller intermediate said second journal means which said cable crosses to said outboard of said journals;

a second and outboard portion of said two-part articulating arm structure movable pivotally in respect to said second journal means at the outboard end of said first arm portion and said tensioned cable means engaging a post provided by said outboard arm portion to which said cable loop is affixed;

tension means at the rear of said first arm portion said tension means grasping both ends of said cable and selectively movable rearwardly thereby tensioning the cable in its engagement with said journal means; and remotely actuated motor means operably connected to said drive shaft whereby said arms are selectively moved.

2. An improved height adjustable arm rest structure for chairs, comprising:

a frame having mounting means for the connection of said frame to the back of a chair;

a drive shaft operably supported by said frame, said shaft extending transversely across said back of a chair;

an arm support block at each end of said frame;

a cable tensioning element secured to said frame and through said support block;

a cable through each support block and over said drive shaft forming a closed loop and said cable adjustably tensioned by said cable tensioning element;

first elongate arm elements pivotally connected to each of said support blocks and extending on each side of said chair and flanking each seat, said first arm element including a double groove roller axled intermediate the ends of said first arm elements and over which said cable is trained;

second elongate arm elements in articulated connected to each of said first arm elements and rotatably connected to each of said first arms and said cable rotatably engaged on the axis of said articulating connection; and said second arms including an outboard journal over which said cables run and each of said cables being fixedly secured to said journals;

a drive element secured to said frame and to said drive shaft and selectively turning said drive shaft whereby resultant motion of said cable selectively raises and lowers said arm; and an operating handle pivotally secured to the second of said arms and manipulable adjacent the end of the outermost ends of said second arms;

3. Controlled tension adjustable height arms for chairs comprising:

a support frame having mounting means for attachment to a chair and a drive shaft extending axially across the back of said chair;

arms connected to the ends of said drive shaft and extending therefrom said arms each having a rear arm and a forearm portion in pivotal articulated relation to each other;

a drive element through each of said arms and operably connected to said drive shaft;

a closed loop cable tensionally engaged with said armed portions whereby motion of said drive shaft results in relative displacement of said articulated arm portions and said tension remains substantially constant;

selectively actuatable motor means driveably connected to said drive shaft; and tension adjusting means connected to and closing said cable.

4. In the claim 3 wherein said motor means drives said drive shaft which turns tensioned arm portions to adjust the height of the arm rests in a stable relation under selected constant and adjustable tension.

5. A positive stop remotely controlled height adjustment for chair arms comprising:

a frame attachable to a chair back;

motor means connected to said frame;

a pair of chair arms adjustably secured to said frame each arm including an aft rest portion and a forearm rest portion in cooperating articulated relation to each other and to said frame;

a motion translating means secured to said frame and operably connected to said motor and to said arms;

adjustable tension cable means in a crossed closed loop over each of said pairs of articulated aft arms and forearms in selected tension relation applying selected constant tension to said arms and fixed to one of said arm elements maintaining stabilizing compression at the articulating points between said arm rest elements and said frame;

adjustable tension applying means connected to said frame and to said cable; and at least one control trigger attached to said forearm portion and operably and remotely activating said motor means to selectively raise and lower said arm elements.

6. In the combination of claim 5 in which said remote activation is achieved by a Bowden-wire means acted upon by said control trigger and in control over said motor means.

* * * * *

UNITED STATES PATENT AND TRADEMARK OFFICE

CERTIFICATE OF CORRECTION

PATENT NO. : 5,169,207

DATED : December 8, 1992

INVENTOR(S) : Ralph K, Rye

It is certified that error appears in the above-indentified patent and that said Letters Patent is hereby corrected as shown below:

In the Abstract:

line 5 change "seletive" to read --- selective ---

Col. 4, line 22 between "best" and "appreciated" insert --- be ---

Col. 4, line 64 change "rob" to read --- rod ---

Col. 5, line 53 change "50" to read --- 60 ---

Col. 7, line 25 change "nected" (at front of line) to read --- nection ---

Signed and Sealed this

Eighth Day of February, 1994

Bruce Lehman

*Attest:*

BRUCE LEHMAN

*Attesting Officer*

*Commissioner of Patents and Trademarks*